United States Patent [19]

Airaghi

[11] Patent Number: 4,807,332

[45] Date of Patent: Feb. 28, 1989

[54] RIGID STRUCTURE FOR ENGAGING PREFERABLY CLOSED ROPE ENDS

[76] Inventor: Cesare Airaghi, Via Bramante, 39, 20100 Milano, Italy

[21] Appl. No.: 60,930

[22] Filed: Jun. 12, 1987

[30] Foreign Application Priority Data

Jul. 8, 1986 [IT] Italy ..... 4928/86[U]

[51] Int. Cl.[4] ..... F16G 11/00

[52] U.S. Cl. ..... 24/129 R; 24/265 R; 70/456 R

[58] Field of Search ..... 70/456 R; 24/115 K, 24/129 R, 129 W, 130, 481, 482, 265 R, 127, 265 A, 129 A; 248/467, 493

[56] References Cited

U.S. PATENT DOCUMENTS

| | | | |
|---|---|---|---|
| 343,849 | 6/1886 | Pond | 24/129 R |
| 440,599 | 11/1890 | Keithly | 248/493 |
| 485,415 | 11/1892 | Kenyon | 24/129 R |
| 1,185,804 | 6/1916 | Lane | 24/129 R |
| 2,093,872 | 9/1937 | McCoy | 24/129 R |
| 2,643,840 | 6/1953 | Lanman | 248/467 X |
| 3,289,260 | 12/1966 | Buscall, Jr. | 24/129 R |
| 3,350,045 | 10/1967 | Mayers | 248/467 X |
| 4,117,574 | 10/1978 | Yoshida | 24/129 R |
| 4,575,905 | 3/1986 | Torrey | 248/493 X |

FOREIGN PATENT DOCUMENTS

| | | | |
|---|---|---|---|
| 2128349 | 12/1971 | Fed. Rep. of Germany | 24/129 R |

*Primary Examiner*—Kenneth J. Dorner
*Assistant Examiner*—James R. Britton
*Attorney, Agent, or Firm*—Stevens, Davis, Miller & Mosher

[57] ABSTRACT

A rigid structure is provided for engaging the ends of ropes preferably closed on themselves. The structure includes a plate having a groove at its perimeter; a first and a second through holes in the plate; a first and a second engaging holes in the plate for housing first and second ends of a rope. The first and second engaging holes are oriented at an angle less than or equal to 90° relative to the perimeter groove in the plate.

12 Claims, 1 Drawing Sheet

Fig. 1
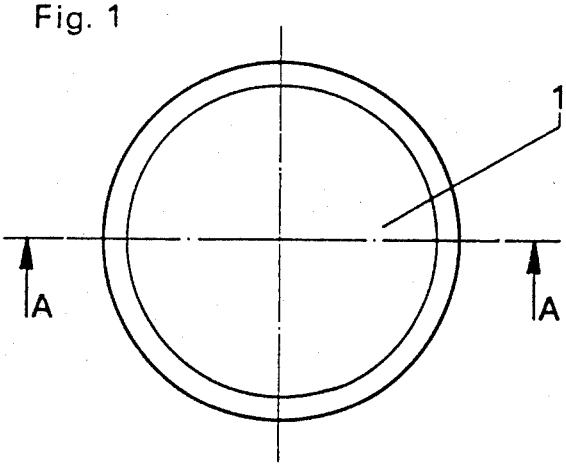
Fig. 3
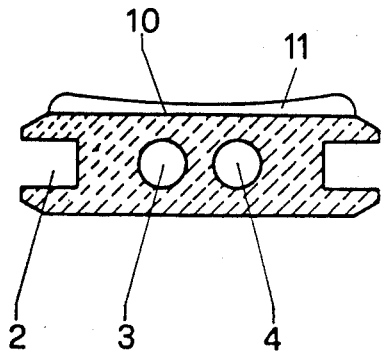
Fig. 2
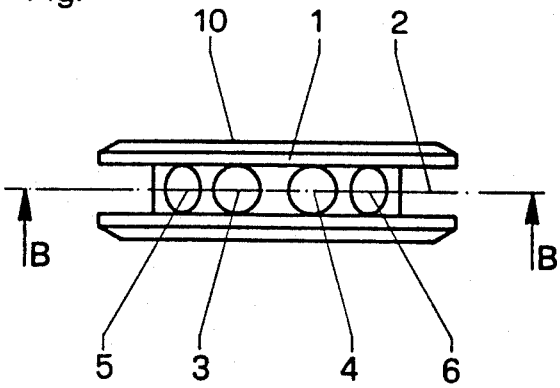
Fig. 4
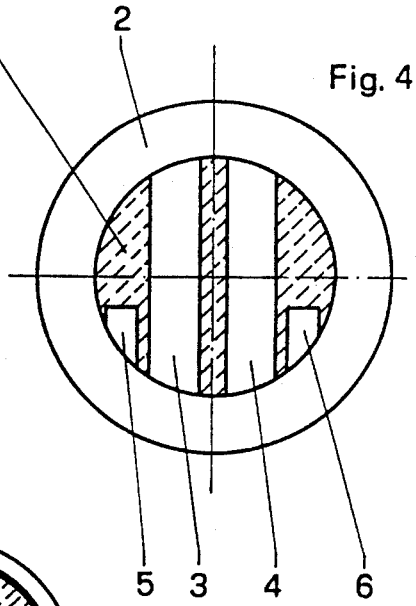
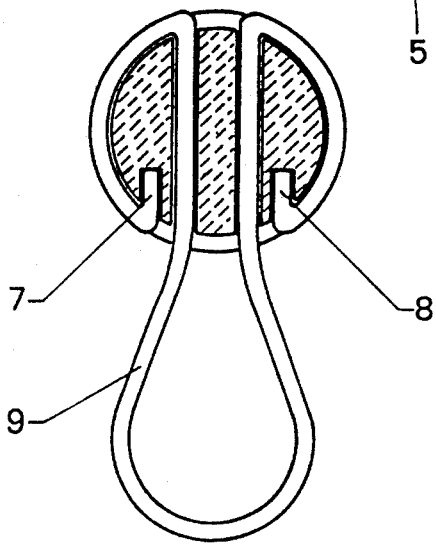
Fig. 5

RIGID STRUCTURE FOR ENGAGING PREFERABLY CLOSED ROPE ENDS

The present invention refers to a rigid structure for engaging rope ends particularly suitable for key-holder plates for hanging tools provided with hooks and similar articles.

Presently the fastening of rope ends on a rigid structure is accomplished by using clamps, screws or by swelling the ends with knots or weld material. This entails assembly difficulties and it also entails the use of special equipment to obtain the assembly.

Further known fixing means tend to decrease the efficiency of the material constituing the rope thus increasing its wear.

These and other problems are solved by the present invention as it is characterized in the attached claims.

The invention is desclosed in great detail below with reference to the attached drawings which represent one preferred but not limiting embodiment.

FIG. 1 shows a plan view of a structure according to the invention.

FIG. 2 shows a side view of the same structure.

FIG. 3 is a cross section view of the structure in accordance with section A—A of FIG. 1.

FIG. 4 is a cross section view of the structure according to plane B—B of FIG. 2.

FIG. 5 shows a structural arrangement of a rope in a structure according to the present invention.

Referring to the drawings, a rigid structure for engaging ropes ends preferably closed on themselves comprises: a circular plate 1 having a perimeter groove 2, two through holes 3,4 and two blind holes 5, 6. Blind holes 5, 6 house, respectively, a first and a second end 7, 8 of a rope 9.

In the embodiment shown in FIG. 5, rope 9 is formed of polyvinil chloride whose resilient characteristics favor the fastening of hole 5 even when the rope 9 is not stretched.

By examining the drawings and in particular FIG. 5 it appears that ends 7, 8 of rope 9 remain engaged in the respective holes 5, 6 due to the friction resistance between rope and hole, with the windup angle of the rope being less than or equal to 90°.

The disclosed embodiment is only one of the feasible embodiments of the invention which can be subjected to variations not affecting its essence.

In particular the plate 1 can be fitted with a suction cup 11 placed on a plane 10, the suction cup being suitable for hanging the device on a wall in order to enable the device to support tools or articles fitted with hooks.

Another embodiment is foreseen in which the suction cup is replaced with a magnet or an adhesive means having the same purpose.

It is intended that the shape of plate 1 can be different from that shown in the drawings. Shape, sizes and materials used do not limit the present invention in which each component can be replaced with another one technically equivalent.

I claim:

1. An assembly comprising a cord and a retaining member securing the ends of said cord, said member comprising a body having a curved groove extending along its perimeter, at least one first bore extending through said body, said first bore being in communication with said groove, and at least one first hole extending from said groove into said body; said first hole and said groove defining an angle therebetween which is less than or equal to 90° wherein said first bore, substantially the entire curved groove, and said first hole extend substantially in the same plane and said first bore and said first hole are substantially parallel.

2. A retaining member as in claim 1, wherein said groove extends completely around the perimeter of said body.

3. A retaining member as claimed in claim 1, wherein said body is substantially cylindrical.

4. A retaining member as claimed in claim 1, further comprising a second bore extending through said body, said second bore being in communication with said groove, and a second hole extending from said groove into said body, wherein said second hole and said groove define an angle therebetween which is less than or equal to 90°.

5. A retaining member as claimed in claim 4, wherein said first bore and said second bore and said first hole and said second hole all extend substantially in the same plane and are substantially parallel.

6. A retaining member as claimed in claims 4 or 5, wherein said cord having one end engaged in said first hole.

7. A retaining member as claimed in claim 4 or 5, wherein said a cord having one end engaged in said first hole and another end engaged in said second hole such that said cord forms a loop.

8. A retaining member as claimed in claim 7, wherein said cord is arranged as a keyholder.

9. A retaining member as claimed in claim 7, wherein said cord is arranged as a tool holder and said body carries fixing means.

10. An assembly comprising a rope and a rigid structure engaging rope ends preferably closed on themselves, said structure comprising a plate having a curved groove in its perimeter; said plate comprising a first and a second through hole intersecting said groove and a first and a second engaging hole intersecting said groove at one side of said perimeter of said plate, said first and second engaging holes respectively housing a first and second end of said rope; said first and second engaging holes being oriented at an angle less than or equal to 90° relative to said groove wherein said holes and substantially the entire curved groove lie substantially in the same plane.

11. A structure as in claim 10, wherein said rope is for hanging keys, said rope having first and second ends engaged respectively in said first and second engaging holes.

12. A structure as in claim 10, wherein said plate further comprises hanging means for hanging said structure on a verticle surface and said rope comprises means for hanging tools having hooks, said rope having first and second ends engaged respectively in said first and second engaging holes.

* * * * *